US008291878B2

(12) United States Patent
Tabinoki et al.

(10) Patent No.: US 8,291,878 B2
(45) Date of Patent: Oct. 23, 2012

(54) 4-STROKE CYCLE INTERNAL COMBUSTION ENGINE

(75) Inventors: Yukihisa Tabinoki, Saitama (JP); Kazuhiro Ikeda, Saitama (JP); Nozomi Okada, Saitama (JP); Koshoku Sai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 413 days.

(21) Appl. No.: 12/721,248

(22) Filed: Mar. 10, 2010

(65) Prior Publication Data

US 2010/0242885 A1 Sep. 30, 2010

(30) Foreign Application Priority Data

Mar. 26, 2009 (JP) ..... 2009-075476

(51) Int. Cl.
*F01L 1/02* (2006.01)

(52) U.S. Cl. ..... 123/90.31

(58) Field of Classification Search ..... 123/90.16, 123/90.31, 193.3, 193.5
See application file for complete search history.

(56) References Cited

U.S. PATENT DOCUMENTS 7,114,474 B2 * 10/2006 Oshita et al. ..... 123/90.31

FOREIGN PATENT DOCUMENTS

JP 05-077522 10/1993

* cited by examiner

*Primary Examiner* — Ching Chang
(74) *Attorney, Agent, or Firm* — Birch, Stewart, Kolasch & Birch, LLP

(57) ABSTRACT

A 4-stroke cycle internal combustion engine includes a breather chamber for separating blow-by gas and oil mist produced in the internal combustion engine. A vehicle-carried 4-stroke cycle internal combustion engine includes a valve chamber wherein a valve motion is accommodated between a cylinder head and a head cover, a cam chain chamber formed from the cylinder head and the cylinder head cover for accommodating a cam chain, a driven sprocket wheel around which the cam chain is wrapped, and a breather chamber formed between an upper portion of the head cover and the valve chamber. A barrier is formed in an arcuate shape opposing to and extending along an outer circumference of the driven sprocket wheel. The barrier is provided sidewardly of the driven sprocket wheel on the breather chamber side.

20 Claims, 9 Drawing Sheets

4-STROKE CYCLE INTERNAL COMBUSTION ENGINE

CROSS-REFERENCE TO RELATED APPLICATIONS

The present application claims priority under 35 USC 119 to Japanese Patent Application No. 2009-075476 filed on Mar. 26, 2009 the entire contents of which are hereby incorporated by reference.

BACKGROUND OF THE INVENTION

1. Field of the Invention

This invention relates to a 4-stroke cycle internal combustion engine which includes a breather chamber.

2. Description of Background Art

In an internal combustion engine, it is desirable to separate a mixture of blow-by gas leaking from a combustion chamber into a crank chamber and oil mist scattered in the internal combustion engine from each other by means of a breather chamber and introduce, in a blow-by gas reduction apparatus for introducing the blow-by gas to an intake system, the blow-by gas into the breather chamber under an environment in which there is a little oil mist.

A 4-stroke cycle internal combustion engine is known wherein a breather plate is interposed between an upper portion of a head cover and a valve chamber which accommodates a valve motion and a breather chamber is formed between the head cover and the breather plate. See, for example, Japanese Utility Model Laid-Open No. Hei 5-77522.

In the vertical 4-stroke cycle internal combustion engine disclosed in Japanese Utility Model Laid-Open No. Hei 5-77522, a plate member is interposed between a cylinder head cover with a valve motion disposed below the cylinder head cover such that a breather chamber is formed below the cylinder head cover by the plate member.

In order to separate oil mist generated in the valve motion below the plate member and a valve motion system power transmission mechanism for transmitting valve driving power from the crankshaft to the valve motion from blow-by gas, a plate member is provided so as to extend from a power transmission mechanism provided at one end of a camshaft to the other end of the camshaft with the opposite side portions of the plate member being bent perpendicularly downwardly at a fold extending in parallel to the camshaft.

In the internal combustion engine disclosed in Japanese Utility Model Laid-Open No. Hei 5-77522, the plate member extends sidewardly of a sprocket wheel, this extension does not play a role in preventing oil mist generated in a valve motion system power transmission mechanism from being scattered in a direction toward the entrance of the breather chamber. Therefore, the internal combustion engine has a problem in that an environment with a small amount of oil mist cannot be produced. Thus, the breather performance is dropped.

Further, since the plate member is provided so as to extend over the substantially overall length of the cylinder head cover, the height of the internal combustion engine is increased by the height of the breather chamber, which is disadvantageous in terms of miniaturization of the internal combustion engine.

SUMMARY AND OBJECTS OF THE INVENTION

According to an embodiment of the present invention, a 4-stroke cycle internal combustion engine is provided which eliminates the problem as described above.

According to an embodiment of the present invention, a vehicle-carried 4-stroke cycle internal combustion engine 1 includes a valve chamber 39 wherein a valve motion is accommodated between a cylinder head 6 and a head cover 7. A cam chain chamber 35 is formed from the cylinder head 6 and the cylinder head cover 7 for accommodating a valve motion transmission system cam chain 28. Cam chain sprocket wheels 26 and 27 are provided between and around which the cam chain 28 is wrapped. A breather chamber 46 is formed between an upper portion of the head cover 7 and the valve chamber 39. A barrier 50 is formed in an arcuate shape opposing to and extending along an outer circumference of the driven sprocket wheel 26 from between the cam chain sprocket wheels is provided sidewardly of the driven sprocket wheel 26 on the breather chamber 46 side.

According to an embodiment of the present invention, the vehicle-carried 4-stroke cycle internal combustion engine includes breather chamber entrances 47 and 48 of the breather chamber 46 that are open in a direction perpendicular to a center axis of rotation of the driven sprocket wheel 26.

According to an embodiment of the present invention, the vehicle-carried 4-stroke cycle internal combustion engine includes the barrier 50 that is formed in an inverted U-shape open downwardly as viewed from the direction of the center axis of rotation of the driven sprocket wheel 26.

According to an embodiment of the present invention, the vehicle-carried 4-stroke cycle internal combustion engine includes one or both end portions of the barrier 50 of the inverted U-shape that are provided on the outer side or sides with respect to one or both of a cam chain tensioner 36 and a cam chain guide 37 as viewed in the direction of the center axis of rotation of the driven sprocket wheel 26.

According to an embodiment of the present invention, the vehicle-carried 4-stroke cycle internal combustion engine includes the barrier 50 that is formed integrally with the cylinder head cover 7 and a lower end of the head cover 7 is extended to a position below a camshaft 21.

According to an embodiment of the present invention, the vehicle-carried 4-stroke cycle internal combustion engine includes the internal combustion engine that is carried on a vehicle such that a crankshaft 8 thereof that is directed in a vehicle widthwise direction with the driven sprocket wheel 26 being disposed rearwardly of the cylinder head cover 7 and the cylinder head cover 7 is formed such that a lower end face thereof is included obliquely downwardly toward the front.

According to an embodiment of the present invention, the vehicle-carried 4-stroke cycle internal combustion engine includes the 4-stroke cycle internal combustion engine with a breather plate 51 attached to the cylinder head cover 7 and forming the breather chamber 46 wherein the barrier 50 is formed integrally with the breather plate 51.

According to an embodiment of the present invention, the barrier 50 formed in an arcuate shape opposing to and extending along the outer circumference of the driven sprocket wheel 26 is provided at a position displaced to the breather chamber 46 from the driven sprocket wheel 26. Therefore, oil mist scattered from the driven sprocket wheel 26 by a centrifugal force is prevented from moving in the direction toward the breather chamber 46 by the barrier 50. Consequently, the oil mist amount to flow into the breather chamber 46 is reduced and the breather performance is enhanced.

Further, since the volume of the breather chamber 46 is decreased by the enhancement of the breather performance, the height of the vehicle-carried 4-stroke cycle internal combustion engine becomes lower. Consequently, it becomes possible to miniaturize and lower the position of the center of gravity of the vehicle-carried 4-stroke cycle internal combustion engine.

According to an embodiment of the present invention, the vehicle-carried 4-stroke cycle internal combustion engine includes the breather chamber entrances 47 and 48 of the breather chamber 46 that are open in a direction perpendicular to the center axis of rotation of the driven sprocket wheel 26. Therefore, oil mist scattered from the driven sprocket wheel 26 is prevented from flowing into the breather chamber 46 from the breather chamber entrances 47 and 48, and the breather performance is enhanced. Further, since the volume of the breather chamber 46 is reduced by the enhancement of the breather performance, miniaturization and lowering of the position of the center of gravity of the vehicle-carried 4-stroke cycle internal combustion engine are promoted.

According to an embodiment of the present invention, the barrier 50 is formed in an inverted U-shape open downwardly as viewed from the direction of the center axis of rotation of the driven sprocket wheel 26. Therefore, oil which has been spattered upwardly by centrifugal force caused by rotation of the driven sprocket wheel and stuck to a top wall face of the cam chain chamber 35 and a wall face of the barrier 50 becomes likely to be collected to the barrier wall end edge portion. Consequently, the oil drops collectively to the bottom of the cam chain chamber 35, and it is prevented that the oil collides with the cam chain 28 and is scattered again.

According to an embodiment of the present invention, one or both of the end portions of the barrier 50 of the inverted U-shape are provided on the outer side or sides with respect to one or both of the cam chain tensioner 36 and the cam chain guide 37 as viewed in the direction of the center axis of rotation of the driven sprocket wheel 26. Therefore, it is prevented that oil sticking to the top wall face of the cam chain chamber 35 and the barrier face and collected to and dropping from the barrier end edge portion collides with and is atomized by the cam chain.

According to an embodiment of the present invention, the barrier 50 is formed integrally with the cylinder head cover 7 with the lower end of the head cover 7 extending to a position below the camshaft 21. Therefore, the barrier can be formed simply. In addition, since the area over which the cylinder head cover 7 covers the cam sprocket wheel 26 can be increased, even if the cylinder head cover 7 is not increased in scale, the barrier face becomes great, and the collection effect of oil and oil mist increases.

According to an embodiment of the present invention, the internal combustion engine is carried on a vehicle such that a crankshaft 8 thereof is directed in a vehicle widthwise direction, and the driven sprocket wheel 26 is disposed rearwardly of the cylinder head cover 7 and the cylinder head cover 7 is formed such that a lower end face thereof is included obliquely downwardly toward the front. Therefore, the barrier face further becomes great, and the collection effect of oil and oil mist further increases.

According to an embodiment of the present invention, the 4-stroke cycle internal combustion engine includes a breather plate 51 attached to the cylinder head cover 7 and forming the breather chamber 46 with the barrier 50 being formed integrally with the breather plate 51. Therefore, the barrier 50 is formed simply to enable a reduction in weight and cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
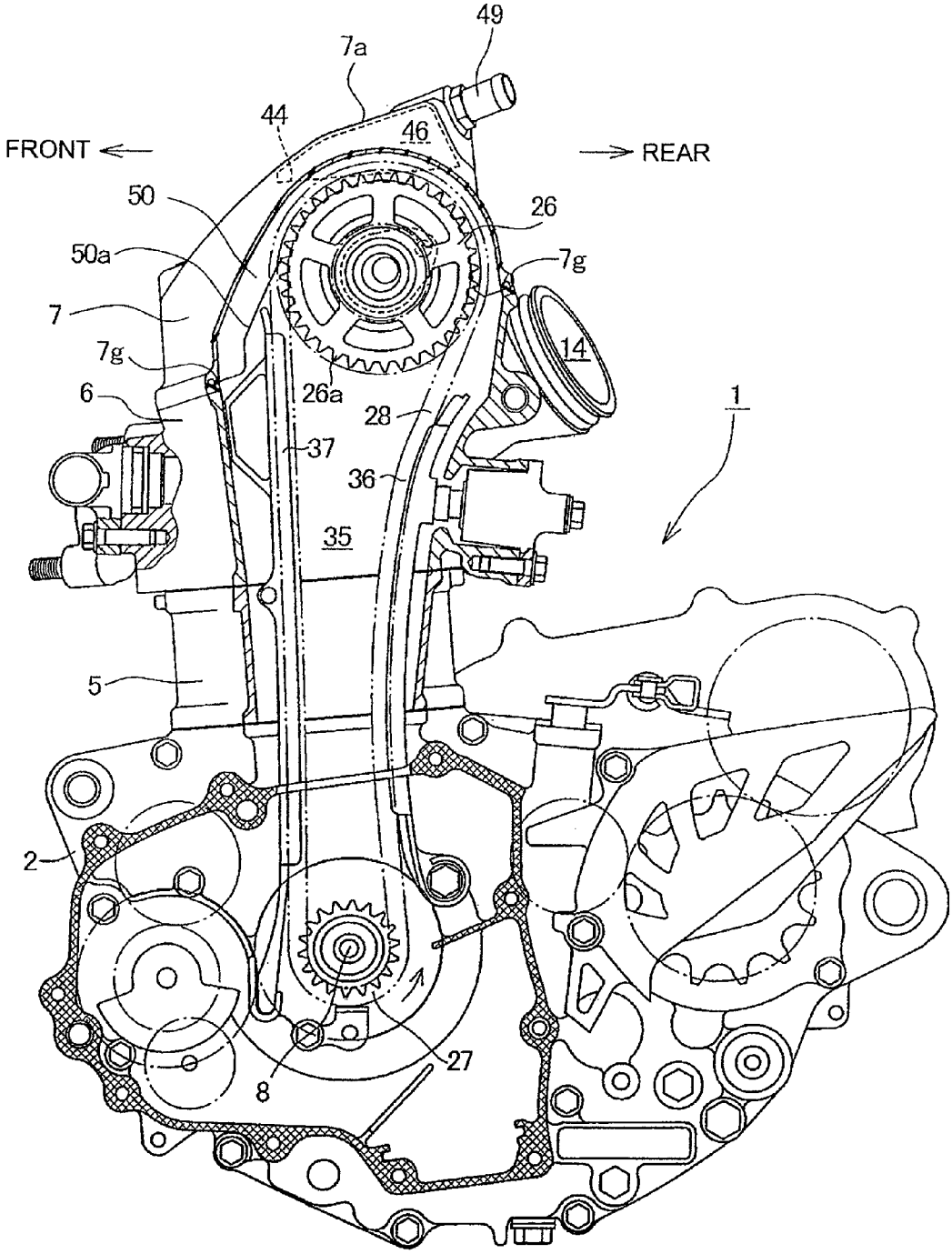
FIG. 1 is a side elevational view, partly broken, showing a vehicle-carried 4-stroke cycle internal combustion engine of the present invention with a left crankcase cover removed.

A first embodiment according to the present invention is illustrated in FIGS. 1 to 7, wherein a water-cooled overhead valve spark ignition type single cylinder 4-stroke cycle internal combustion engine 1 is an internal combustion engine which is carried on a motorcycle not shown such that a cylinder thereof is inclined forwardly a little. In this water-cooled overhead valve spark ignition type single cylinder 4-stroke cycle internal combustion engine 1, a cylinder block 5, a cylinder head 6 and a cylinder head cover 7 are placed in order on a crankcase 2 having a left crankcase 3 and a right crankcase 4 mounted on the left and right thereof. The crankcase 2, cylinder block 5 and cylinder head 6 are coupled integrally with each other by bolts which extend upwardly and downwardly through them.

A crankshaft 8 is supported for rotation on the crankcase 2 such that it is directed in a vehicle widthwise direction, and a piston 10 is fitted for upward and downward sliding movement in a cylinder bore 9 of the cylinder block 5. The piston 10 and the crankshaft 8 are connected to each other by a connecting rod 11. A combustion chamber 12 is defined by a concave face of a substantially triangular shape in section at the center of a lower face of the cylinder head 6, the cylinder bore 9 and a top face of the piston 10. Mixture in the combustion chamber 12 is ignited by an ignition plug 13 in the proximity of the top dead center of the piston 10 in the combustion chamber 12 such that the piston 10 is pushed downwardly by the pressure of combustion gas of the mixture so that the crankshaft 8 is driven to rotate.

Further, a pair of left and right intake ports 14 are formed on the vehicle body rear side (right side in FIG. 3) of the cylinder head 6 and a pair of left and right exhaust ports 15 are formed on the vehicle body front side (left side in FIG. 3) of the cylinder head 6. An intake valve 16 and an exhaust valve 17 for opening and closing openings of each of the intake ports 14 and each of the exhaust ports 15, respectively, are fitted for sliding movement in guide cylinders 18 at a small valve included angle. A valve spring 20 is interposed between a retainer 19 provided at each of the intake valves 16 and the exhaust valves 17 and the top face of the cylinder head 6 such that the intake valves 16 and the exhaust valves 17 are normally closed by the spring force of the valve springs 20.

Figure 3:
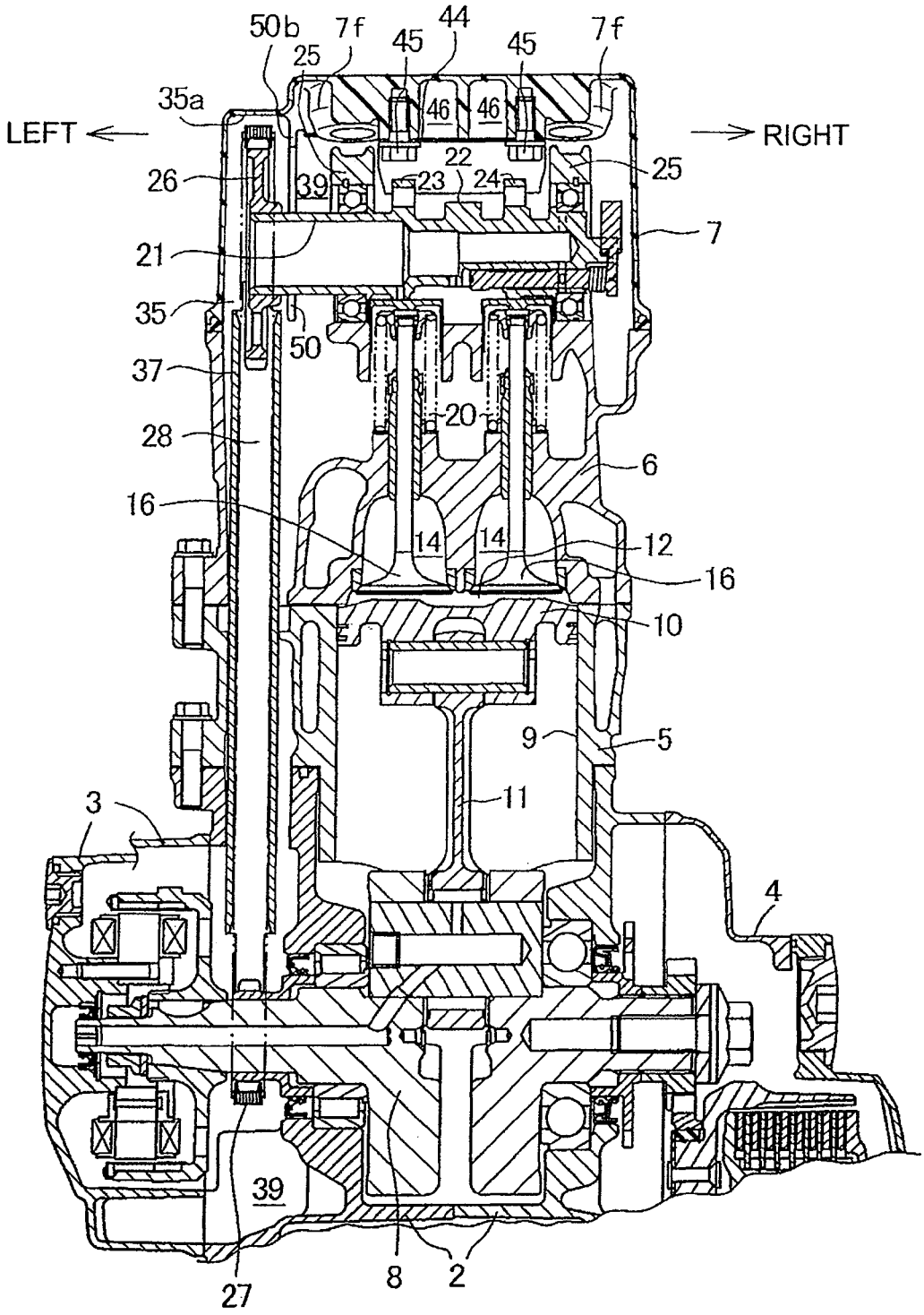
FIG. 3 is a vertical sectional view taken along line of FIG. 2.

Furthermore, as shown in FIG. 3, a camshaft holder 25 produced by die casting for supporting the camshaft 21 for rotation through roller bearings such that the camshaft 21 extends in parallel to the crankshaft 8 is mounted integrally on the cylinder head 6 by bolts not shown. A driven sprocket wheel 26 from between cam chain sprocket wheels is fitted integrally at a left end of the camshaft 21. An endless cam chain 28 extends between and around a driving sprocket wheel 27 fitted on the left side of the crankshaft 8 and the driven sprocket wheel 26. The number of teeth of the driving sprocket wheel 27 and the driven sprocket wheel 26 are set to 2:1 so that, when the crankshaft 8 rotates, the camshaft 21 is driven to rotate at a speed of rotation equal to one half the speed of rotation of the crankshaft 8.

Figure 2:
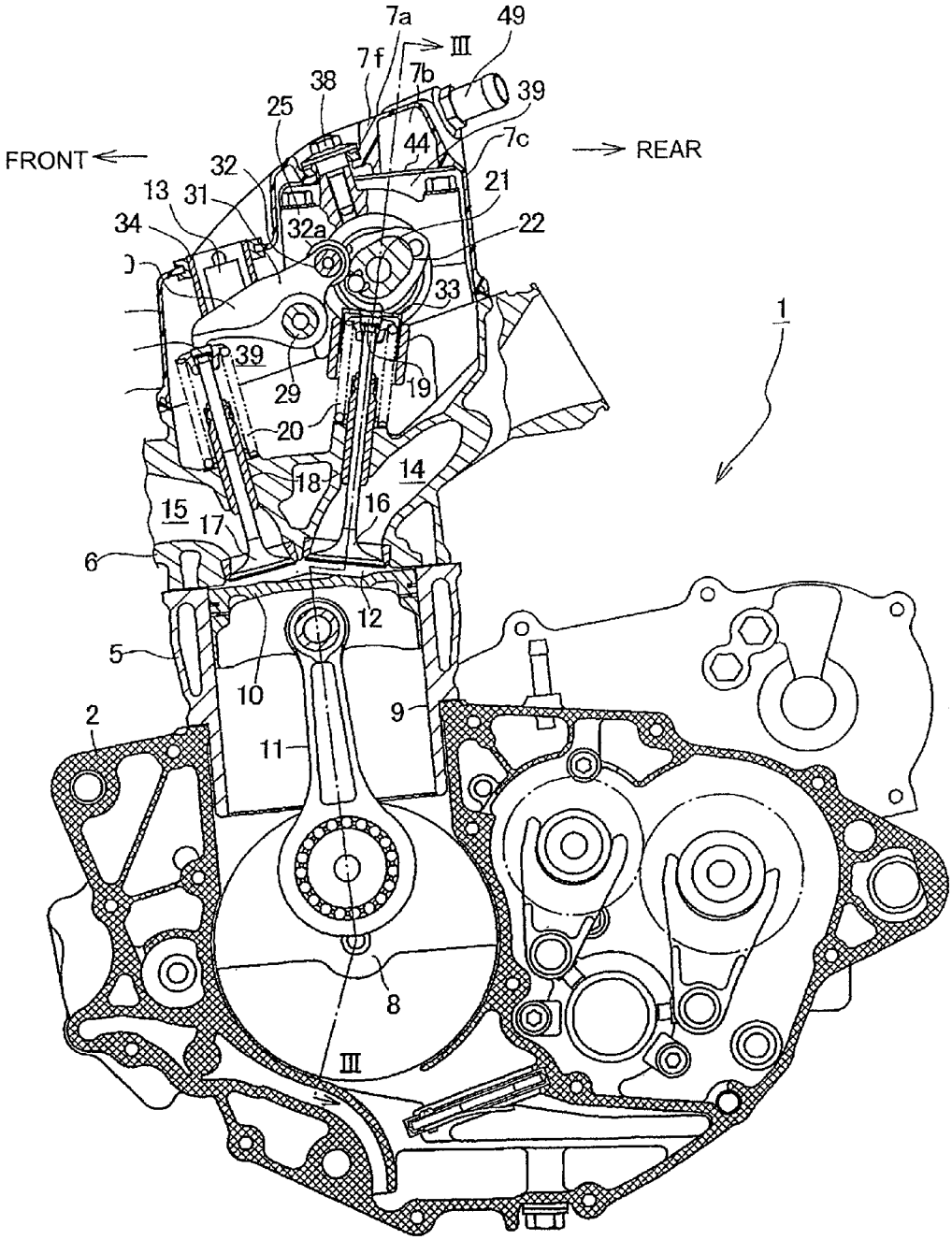
FIG. 2 is a vertical sectional view taken along a center line of a cylinder block of the internal combustion engine shown in FIG. 1.

Further, as seen in FIG. 2, a rocker arm shaft 29 is fitted in the camshaft holder 25 at a position below the camshaft 21 forwardly on the front side (left side) of the vehicle body with respect to the camshaft 21, and a rocker arm 30 is supported for rocking motion on the rocker arm shaft 29. A roller 32*a* is supported for rotation by a shaft 32 on a pair of left and right brackets 31 at one end (rear end side of the vehicle body) of the rocker arm 30. The rocker arm 30 is branched at the other end thereof to the left and right so as to form a U-shape, and the ends of the branched portions contact with the top ends of the two exhaust valves 17 positioned forwardly (left side in FIG. 1) of the vehicle body. The roller 32*a* at one end of the rocker arm 30 is abutted at a position forwardly of the vehicle body by a cam robe 22 at the center of the camshaft 21.

Further, cam robes 23 and 24 positioned on the opposite vehicle body left and right sides of the central cam robe 22 are abutted by the top ends of the two intake valves 16 positioned rearwardly of the vehicle body (on the right side in FIG. 1) through lifters 33. The cam robes 22, 23 and 24 are formed in individually predetermined shapes so that an intake characteristic and an exhaust characteristic suitable for a required operation situation of the water-cooled overhead valve spark ignition type single cylinder 4-stroke cycle internal combustion engine 1 may be provided to the intake valves 16 and the exhaust valves 17.

Furthermore, as shown in FIG. 2, an ignition plug guide cylinder 34 is formed integrally on the cylinder head 6 in a rather forwardly inclined state at a substantially central position between the intake valves 16 and the exhaust valves 17 as viewed in a side elevation. The ignition plug 13 is removably fitted at a lower end of the ignition plug guide cylinder 34. It is to be noted that the ignition plug guide cylinder 34 may be force fitted integrally in the cylinder head 6 or may be cast integrally with the cylinder head 6.

Figure 4:
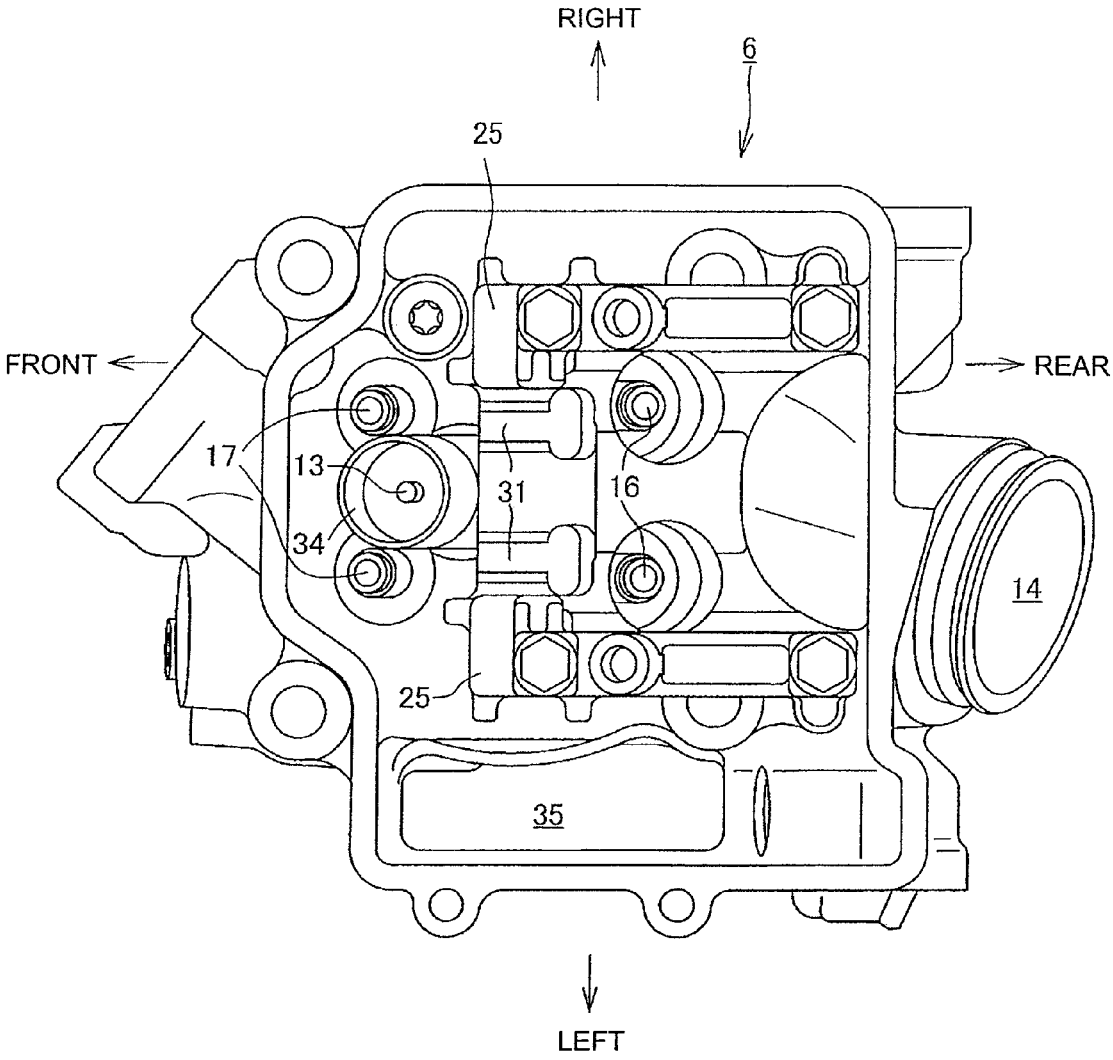
FIG. 4 is a plan view showing the internal combustion engine shown in FIG. 1 with a cylinder head cover removed.

As shown in FIGS. 3 and 4, at a position at which the driven sprocket wheel 26 and the driving sprocket wheel 27 are disposed on the left side in the water-cooled overhead valve spark ignition type single cylinder 4-stroke cycle internal combustion engine 1, a cam chain chamber 35 is formed from the cylinder head 6 toward the driving sprocket wheel 27 in the space between the crankcase 2 and the left crankcase 3 through the cylinder block 5. As shown in FIG. 1, a chain tensioner 36 for absorbing the slackening of the cam chain 28 is disposed rearwardly of the cam chain chamber 35 while a cam chain guide 37 is disposed forwardly of the cam chain chamber 35.

Figure 6:
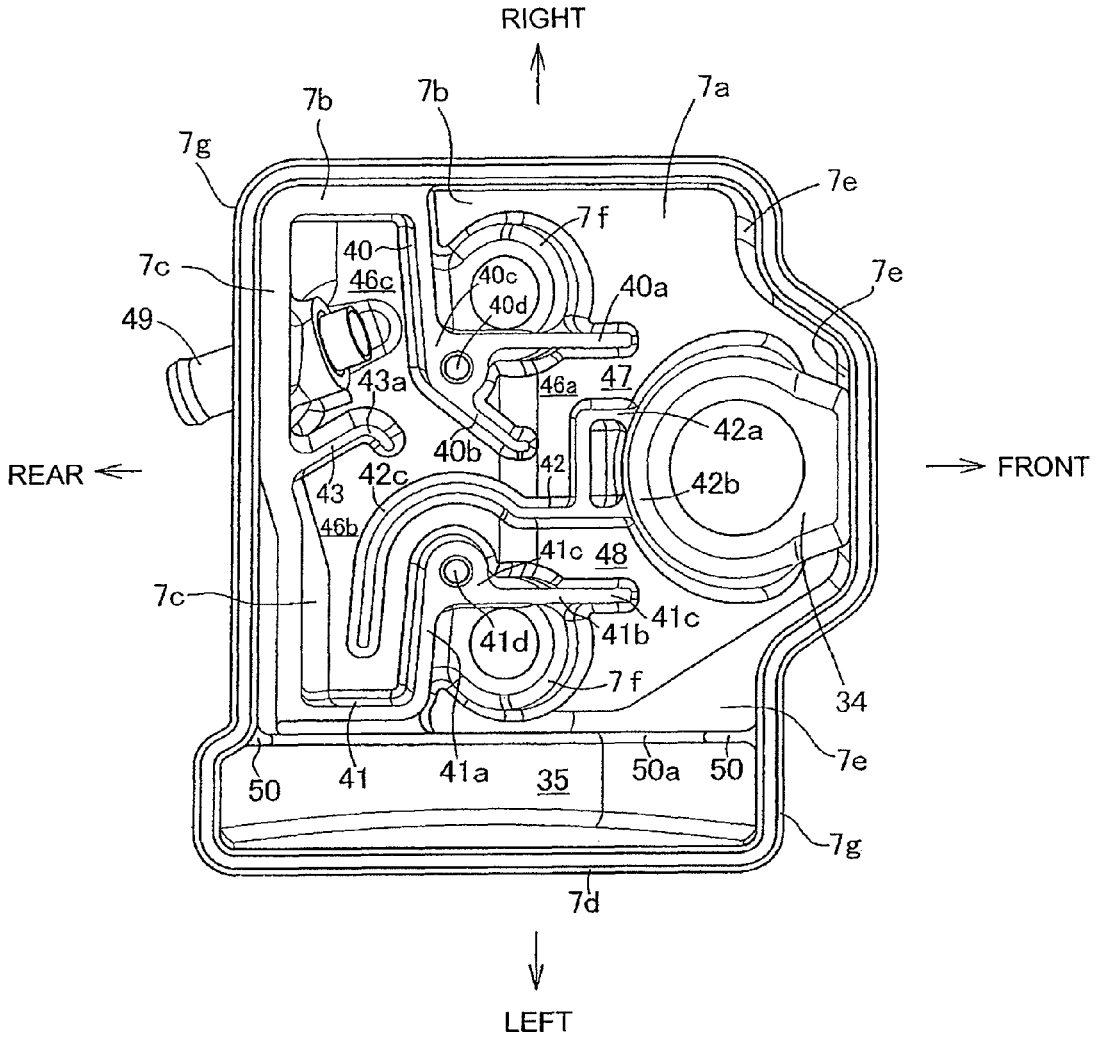
FIG. 6 is a rear elevational view showing the internal combustion engine shown in FIG. 1 with the cylinder head cover turned over.

On a top wall 7*a* of the cylinder head cover 7, recessed portions 7*f* are formed which are positioned at a substantially central position in the forward and backward direction above the left and right camshaft holders 25 and are recessed downwardly as seen in FIGS. 2 and 6. A bolt 38 extending downwardly from upwardly through a hole of each of the recessed portions 7*f* is screwed in a threaded hole of the camshaft holder 25 to attach the cylinder head cover 7 to the cylinder head 6.

Figure 5:
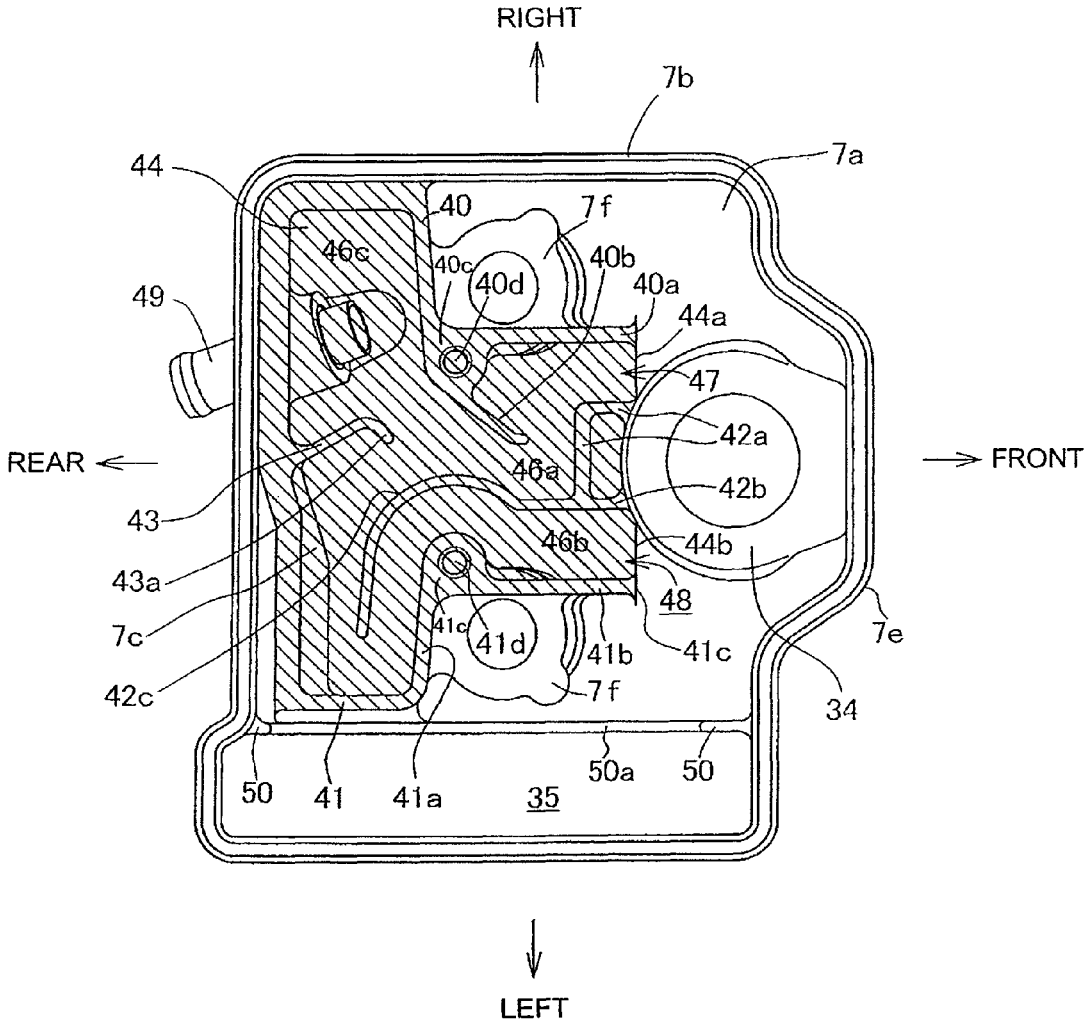
FIG. 5 is a rear elevational view showing the internal combustion engine shown in FIG. 1 where a partition plate for defining a breather chamber is attached to the cylinder head cover.
Figure 7:
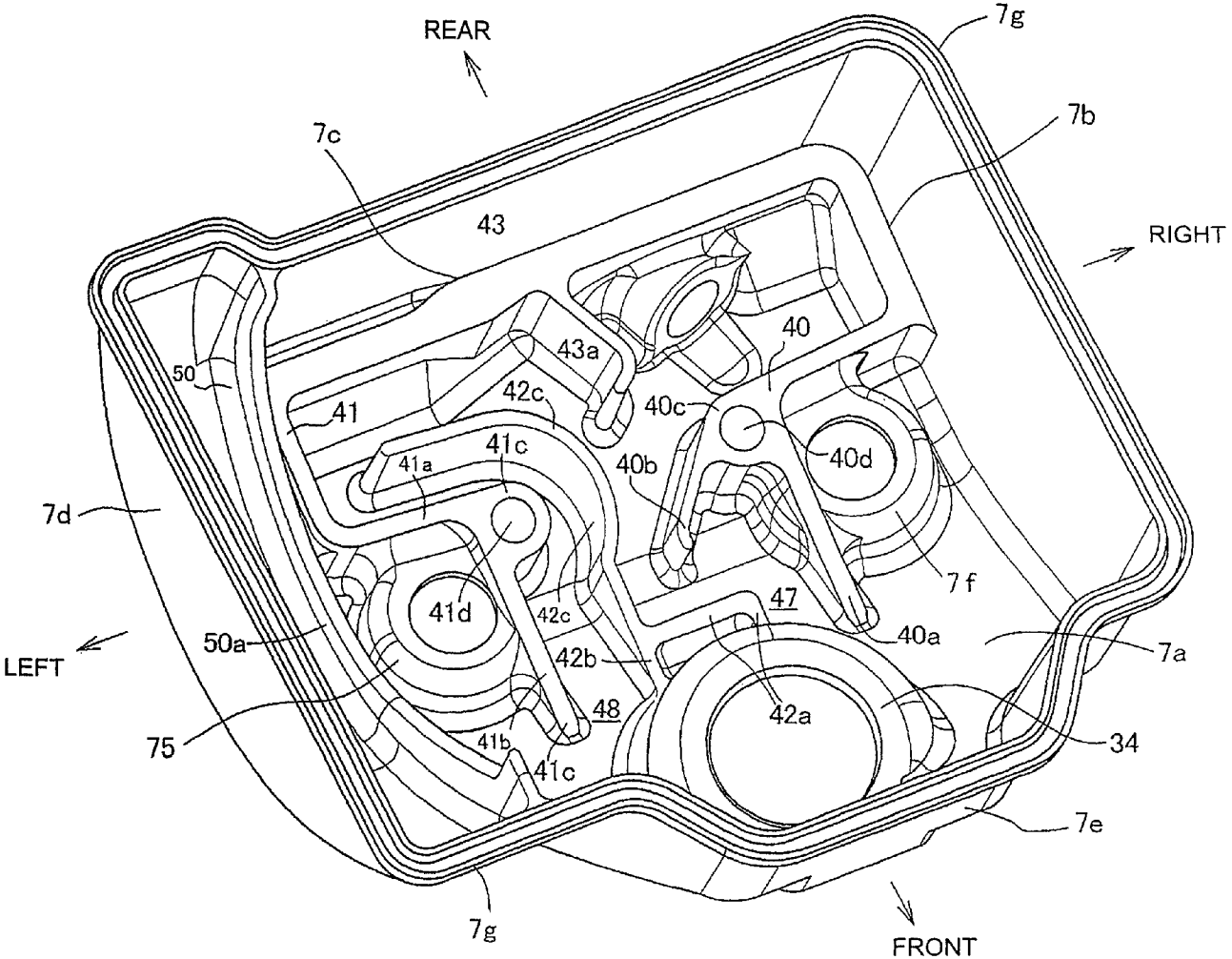
FIG. 7 is a perspective view of a rear face of the cylinder head cover shown in FIG. 6.

On an inner face of the top portion of the cylinder head cover 7, four ribs including a first rib 40, a second rib 41, a third rib 42 and a fourth rib 43 depending downwardly from the top wall 7*a* of the cylinder head cover 7 are formed as seen in FIGS. 5 to 7. Of the four ribs, the first rib 40 projects at a right angle to the left from a location of the cylinder head cover 7 displaced to the rear side of a right side wall 7*b*. The end of the first rib 40 is branched into two ribs, and an end branch rib 40*a* which is one of the branched ribs of the first rib 40 is directed forwardly in parallel to the right side wall 7*b* while an end branch rib 40*b* which is the other one of the branched ribs is directed obliquely to the left and forward.

As illustrated in FIGS. 5 to 7, the second rib 41 projects forwardly from a rear wall 7*c* of the cylinder head cover 7 along the inner side of a barrier 50 hereinafter described and is bent to the right at a rear portion of the cylinder head cover 7 with respect to the recessed portion 7*f* to form a bent portion 41*a*. Then, the second rib 41 is bent back forwardly from the bent portion 41*a* to form a folded back portion 41*b*. Further, threaded holes 40*d* and 41*d* for attaching a breather plate 44 hereinafter described are provided in a bent portion 40*c* of the first rib 40 and a bent portion 41*c* of the second rib 41, respectively.

Further, on the third rib 42, two rear projections 42*a* and 42*b* are formed from two locations of a rear outer circumferential face of the ignition plug guide cylinder 34. The right rear projection 42*a* is bent at the right angle to the left and merges into the left side rear projection 42*b*, and an extension 42*c* formed by the merge of the rear projections 42*a* and 42*b* is curved into an arcuate face centered at the threaded hole 41*d* and is formed substantially in parallel to the bent portion 41*a* of the second rib 41.

Furthermore, the fourth rib 43 projects from a substantially central portion in the leftward and rightward direction of the rear wall 7*c* of the cylinder head cover 7 in a direction substantially parallel to the extension 42*c* of the third rib 42. An end portion 43*a* of the fourth rib 43 is bent substantially at a right angle toward the arcuate extension 42*c* of the third rib 42.

The breather plate 44 in the form of a flat plate is formed in a shape of a portion indicated by hatching lines in FIG. 5, and circular holes are formed in the breather plate 44 at locations the same as those of the threaded holes 40*d* and 41*d* of the first rib 40 and the second rib 41. As shown in FIG. 3, the breather plate 44 is attached in a closely contacting relationship to the first rib 40, second rib 41, third rib 42 and fourth rib 43 by bolts 45 which extend upwardly from below in the circular holes of the breather plate 44 and are screwed in the threaded holes 40*d* and 41*d* of the first rib 40 and the second rib 41 of the cylinder head cover 7. A breather chamber 46 is formed by the first rib 40, second rib 41, third rib 42, fourth rib 43 and breather plate 44.

As shown in FIG. 5, one breather chamber entrance 47 of the breather chamber 46 is formed from the top wall 7*a* of the cylinder head cover 7, the end branch rib 40*a* of the first rib 40, the rear projection 42*a* of the third rib 42 and a front end edge 44*a* of the breather plate 44. The other breather chamber entrance 48 of the breather chamber 46 is formed by the top wall 7*a* of the cylinder head cover 7, a front end edge 41*c* of the folded back portion 41*b*, the rear projection 42*b* of the third rib 42 and a front end edge 44*b* of the breather plate 44. The breather chamber 46 is formed from a breather path 46*a* communicating with the breather chamber entrance 47, a breather path 46*b* communicating with the breather chamber entrance 48, the top wall 7*a*, right side wall 7*b*, rear wall 7*c* and first rib 40 of the cylinder head cover 7 and a breather collecting path 46*c* surrounded by the fourth rib 43. An end of a breather chamber exit pipe 49 is communicated with the breather collecting path 46*c*, and the breather collecting path 46*c* of the breather chamber 46 and an intake path not shown connected to the intake port 14 are communicated with each other by a communicating pipe not shown.

By this structure, while blow-by gas and oil mist floating in an internal space of the water-cooled overhead valve spark ignition type single cylinder 4-stroke cycle internal combustion engine 1 surrounded by the cylinder head 6 and the cylinder head cover 7 pass the breather collecting path 46*c* from the breather chamber entrance 47 and the breather chamber entrance 48 of the breather chamber 46 through the breather paths 46*a* and 46*b*, the blow-by mist and the oil mist are separated from each other. The blow-by gas is taken into the combustion chamber 12 from the breather collecting path 46*c* through the breather chamber exit pipe 49, a communicating pipe not shown, the intake path and the intake port 14. The separated oil drops from the breather plate 44 (refer to FIG. 2), which is inclined downwardly toward the front, to the bottom of the cam chain chamber 35 through the breather chamber entrance 47 and the breather chamber entrance 48.

In addition, a left side portion of the top wall 7*a* of the cylinder head cover 7 is formed in a substantially arcuate shape along an outer circumferential face of the driven sprocket wheel 26 as shown in FIG. 1. The barrier 50 of an arcuate belt shape as viewed in a side elevation separates an upper portion of the cam chain chamber 35 from the valve chamber 39 of an upper space of the valve motion formed from the intake valve 16, exhaust valve 17, cam robe 22, cam robe 23, cam robe 24, rocker arm 30, bracket 31, lifter 33 and so forth positioned to the right with respect to the upper portion of the cam chain chamber 35 and is formed integrally with a left side portion of the top wall 7*a* of the cylinder head cover 7. A lower edge 50*a* of the barrier 50 has a width of such a degree that it covers a root portion of a toothed portion 26*a* of the driven sprocket wheel 26 as viewed in side elevation (refer to FIG. 1).

In the embodiment according to the present invention shown in FIGS. 1 to 7, when blow-by gas and oil mist produced in the water-cooled overhead valve spark ignition type single cylinder 4-stroke cycle internal combustion engine 1 flow into the cam chain chamber 35 and move up in the cam chain chamber 35 until they reach an upper portion of the cam chain chamber 35, since an upper circumferential portion 35*a* of the cam chain chamber 35 and a circumferential face portion of the valve chamber 39 are partitioned from each other by the barrier 50, the oil mist scattered from the driven sprocket wheel 26 and the cam chain 28 by centrifugal force is suppressed from moving into the valve chamber 39 by the barrier 50. Consequently, the oil mist amount to flow into the valve chamber 39 decreases and the breather performance is enhanced.

Further, since the volume of the breather chamber 46 decreases by the enhancement of the breather performance, the height of the water-cooled overhead valve spark ignition type single cylinder 4-stroke cycle internal combustion engine 1 becomes lower. In addition, it is possible to miniaturize and lower the position of the center of gravity of the water-cooled overhead valve spark ignition type single cylinder 4-stroke cycle internal combustion engine 1.

Furthermore, since the lower edge 50*a* of the barrier 50 has a width of such a degree that it covers a root portion of the toothed portion 26*a* of the driven sprocket wheel 26 as viewed in side elevation (refer to FIG. 1), oil mist scattered from the driven sprocket wheel 26 and the cam chain 28 is prevented from flowing into the valve chamber 39 across the barrier 50. Consequently, the oil mist amount to flow into the breather chamber 46 is decreased and the breather performance of the breather chamber 46 is enhanced.

Furthermore, since the barrier 50 is formed in an inverted U-shape from the direction of the axis of the camshaft 21 and a lower end portion of the lower edge 50*a* extends to a lower edge line 7*g* of the cylinder head cover 7, oil sticking to a side face 50*b* of the barrier 50 rather near to the cam chain chamber 35 does not flow into the valve chamber 39 and can be dropped with certainty to the bottom of the cam chain chamber 35 immediately below the valve chamber 39. Consequently, the oil consumption amount decreases.

Since the breather chamber entrance 47 and the breather chamber entrance 48 of the breather chamber 46 are directed in parallel to the plane of rotation of the driven sprocket wheel 26, oil mist scattered from the driven sprocket wheel 26 by centrifugal force does not move toward the breather chamber entrance 47 and the breather chamber entrance 48 of the breather chamber 46. Consequently, the breather performance of the breather chamber 46 is further enhanced.

Further, since the opposite lower end portions of the barrier 50 of the inverted U-shape as viewed from the direction of the center axis of rotation of the driven sprocket wheel 26, that is, from the direction of the center axis of the camshaft 21, are positioned on the outer sides with respect to the chain tensioner 36 and the cam chain guide 37, when oil sticking to the side face 50*b* of the barrier 50 drops downwardly from the lower edge 50*a* of the barrier 50, it drops rearwardly of the cam chain tensioner 36 and forwardly of the chain guide 37 and does not stick to the chain tensioner 36 or the cam chain guide 37. As a result, circulation of the oil is carried out smoothly and deterioration of the oil is prevented.

While, in the first embodiment, the opposite lower end portions of the barrier 50 of the inverted U-shape are positioned on the outer sides with respect to the chain tensioner 36 and the cam chain guide 37, an end portion of the barrier 50 of the inverted U-shape may otherwise be positioned on the outer side with respect to one of the chain tensioner 36 and the cam chain guide 37.

Further, since the barrier 50 is formed integrally with the cylinder head cover 7, the breather chamber 46 can be formed simply. Thus, a reduction in the cost can be achieved.

Furthermore, since the crankshaft 8 of the water-cooled overhead valve spark ignition type single cylinder 4-stroke cycle internal combustion engine 1 is carried on the vehicle such that it is directed in the vehicle widthwise direction and the driven sprocket wheel 26 is disposed rearwardly of the cylinder head cover 7 while the lower edge line 7*g* of the cylinder head cover 7 is inclined downwardly toward the front of the vehicle, the volume of the barrier 50 increases, and the collection effect of oil and oil mist is further enhanced.

Figure 8:
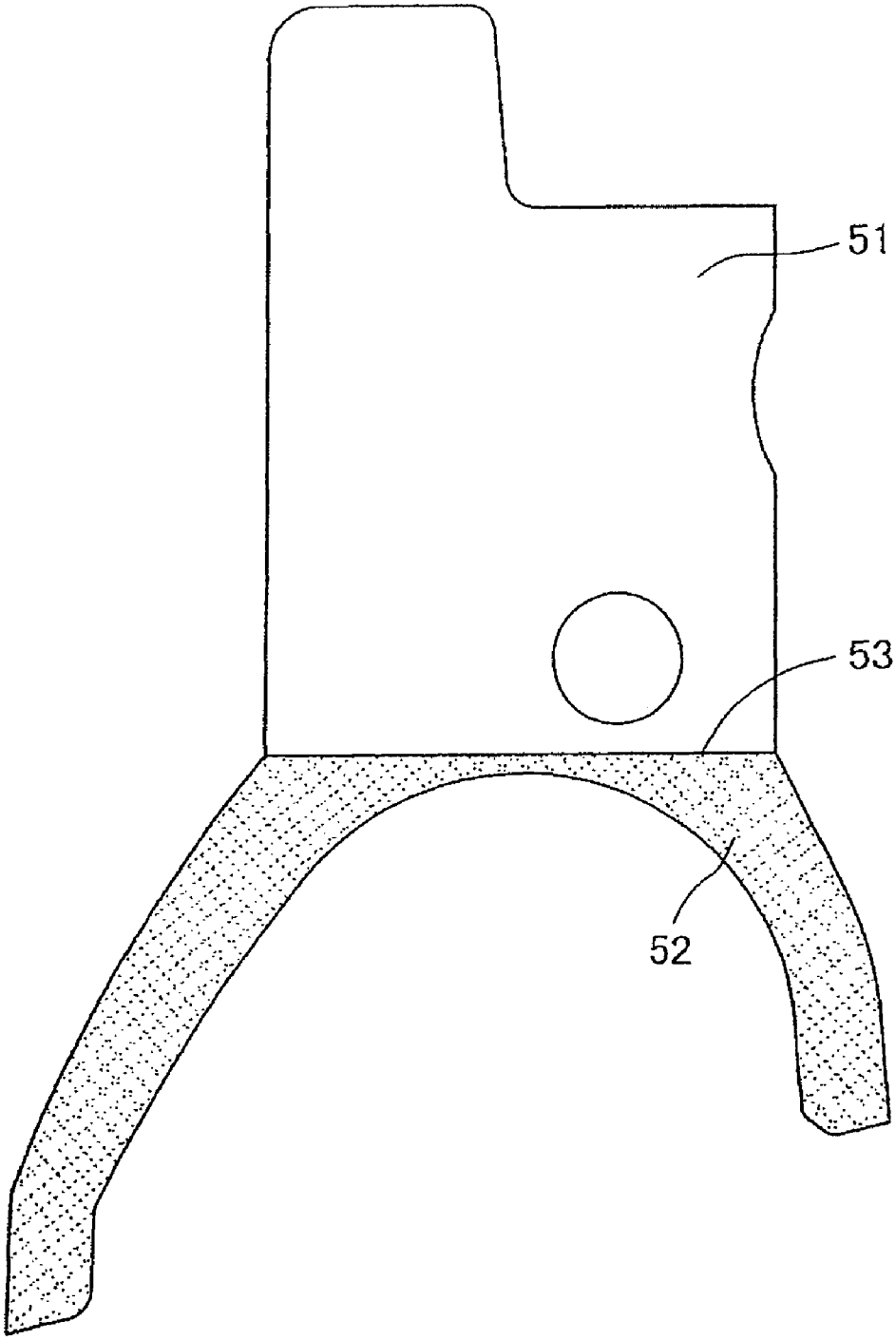
FIG. 8 is a developed view of a breather plate.
Figure 9:
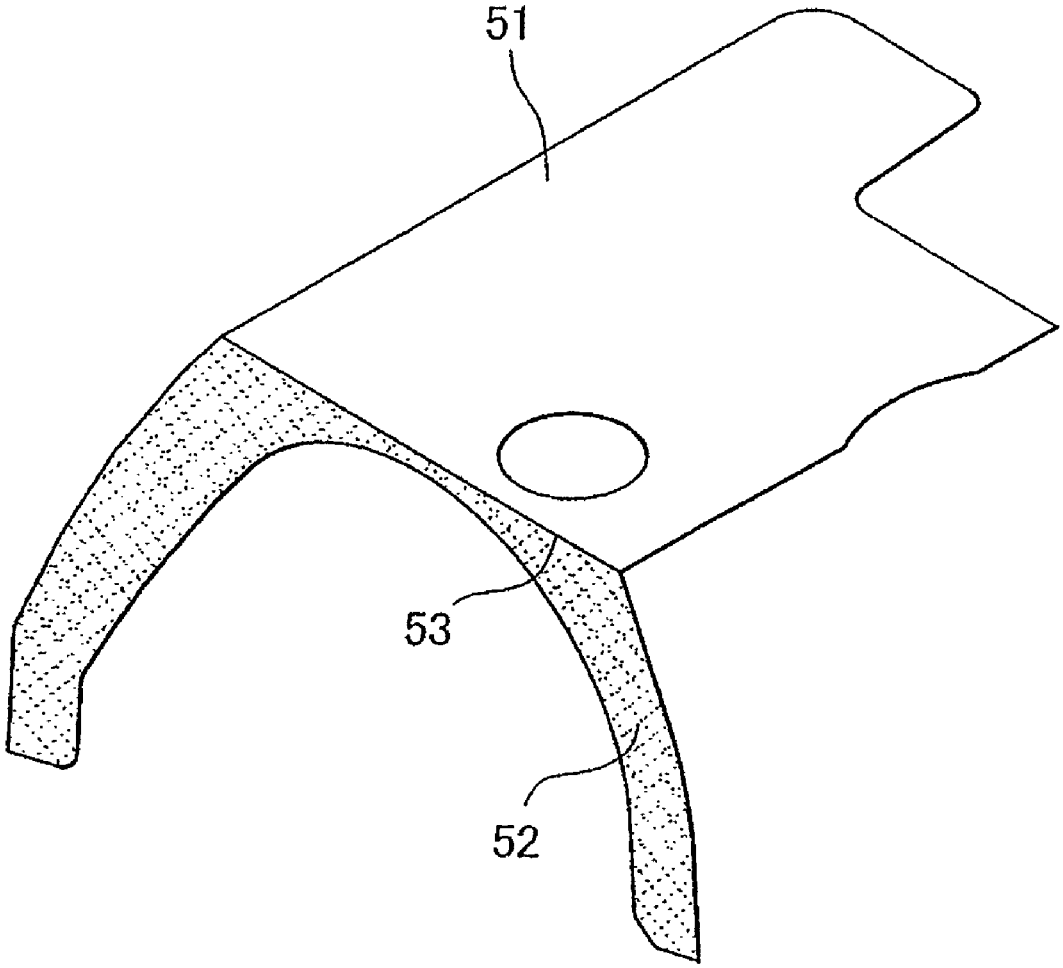
FIG. 9 is a perspective view showing another embodiment wherein a barrier is coupled integrally to a breather plate.

While, in the first embodiment, shown in FIGS. 1 to 7, the barrier 50, integrated with the cylinder head cover 7 made of light alloy, is formed as a separate member from the breather plate 44 made of metal. In the second embodiment, shown in FIGS. 8 and 9, the breather plate 51 made of metal and a barrier 52 made of metal are formed as an integrated member. In addition, the breather plate 51 is bent perpendicularly downwardly at a fold 53 as shown in FIG. 9.

In the second embodiment shown in FIGS. 8 and 9, in a 4-stroke cycle internal combustion engine wherein a plurality of ribs are formed on a lower face of a top wall of a cylinder head cover as in the first embodiment and a breather plate is attached to a lower face of the ribs, even if a barrier is not formed in advance on the cylinder head cover, the barrier 52 can be provided sidewardly of the breather chamber by later mounting.

While, in the first and second embodiments described above, the present invention is applied to a single cylinder internal combustion engine, the present invention can be applied also to a multi-cylinder internal combustion engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle-carried 4-stroke cycle internal combustion engine comprising:

a valve chamber wherein a valve motion is accommodated between a cylinder head and a head cover;

a cam chain chamber formed from said cylinder head and said cylinder head cover for accommodating a valve motion transmission system cam chain;

cam chain sprocket wheels between and around which said cam chain is wrapped;

a breather chamber formed between an upper portion of said head cover and said valve chamber; and a barrier formed in an arcuate shape opposing to and extending along an outer circumference of a driven sprocket wheel from between said cam chain sprocket wheels, said barrier being provided sidewardly of said driven sprocket wheel on said breather chamber side.

2. The vehicle-carried 4-stroke cycle internal combustion engine according to claim 1, wherein breather chamber entrances of said breather chamber are open in a direction perpendicular to a center axis of rotation of said driven sprocket wheel.

3. The vehicle-carried 4-stroke cycle internal combustion engine according to claim 2, wherein said barrier is formed in an inverted U-shape open downwardly as viewed from the direction of the center axis of rotation of said driven sprocket wheel.

4. The vehicle-carried 4-stroke cycle internal combustion engine according to claim 2, wherein one or both of end portions of said barrier of the inverted U-shape are provided on the outer side or sides with respect to one or both of a cam chain tensioner and a cam chain guide as viewed in the direction of the center axis of rotation of said driven sprocket wheel.

5. The vehicle-carried 4-stroke cycle internal combustion engine according to claim 2, wherein said barrier is formed integrally with said cylinder head cover and a lower end of said cylinder head cover extends to a position below a camshaft.

6. The vehicle-carried 4-stroke cycle internal combustion engine according to claim 2, wherein said internal combustion engine is carried on a vehicle such that a crankshaft thereof is directed in a vehicle widthwise direction, and said driven sprocket wheel is disposed rearwardly of said cylinder head cover and said cylinder head cover is formed such that a lower end face thereof is included obliquely downwardly toward the front.

7. The vehicle-carried 4-stroke cycle internal combustion engine according to claim 2, wherein said 4-stroke cycle internal combustion engine comprises a breather plate attached to said cylinder head cover and foaming said breather chamber, and said barrier is formed integrally with said breather plate.

8. The vehicle-carried 4-stroke cycle internal combustion engine according to claim 1, wherein said barrier is formed in an inverted U-shape open downwardly as viewed from the direction of the center axis of rotation of said driven sprocket wheel.

9. The vehicle-carried 4-stroke cycle internal combustion engine according to claim 8, wherein one or both of end portions of said barrier of the inverted U-shape are provided on the outer side or sides with respect to one or both of a cam chain tensioner and a cam chain guide as viewed in the direction of the center axis of rotation of said driven sprocket wheel.

10. The vehicle-carried 4-stroke cycle internal combustion engine according to claim 8, wherein said barrier is formed integrally with said cylinder head cover and a lower end of said cylinder head cover extends to a position below a camshaft.

11. The vehicle-carried 4-stroke cycle internal combustion engine according to claim 8, wherein said internal combustion engine is carried on a vehicle such that a crankshaft thereof is directed in a vehicle widthwise direction, and said driven sprocket wheel is disposed rearwardly of said cylinder head cover and said cylinder head cover is formed such that a lower end face thereof is included obliquely downwardly toward the front.

12. The vehicle-carried 4-stroke cycle internal combustion engine according to claim 1, wherein one or both of end portions of said barrier of the inverted U-shape are provided on the outer side or sides with respect to one or both of a cam chain tensioner and a cam chain guide as viewed in the direction of the center axis of rotation of said driven sprocket wheel.

13. The vehicle-carried 4-stroke cycle internal combustion engine according to claim 12, wherein said barrier is formed integrally with said cylinder head cover and a lower end of said cylinder head cover extends to a position below a camshaft.

14. The vehicle-carried 4-stroke cycle internal combustion engine according to claim 12, wherein said internal combustion engine is carried on a vehicle such that a crankshaft thereof is directed in a vehicle widthwise direction, and said driven sprocket wheel is disposed rearwardly of said cylinder head cover and said cylinder head cover is formed such that a lower end face thereof is included obliquely downwardly toward the front.

15. The vehicle-carried 4-stroke cycle internal combustion engine according to claim 1, wherein said barrier is formed integrally with said cylinder head cover and a lower end of said cylinder head cover extends to a position below a camshaft.

16. The vehicle-carried 4-stroke cycle internal combustion engine according to claim 15, wherein said internal combustion engine is carried on a vehicle such that a crankshaft thereof is directed in a vehicle widthwise direction, and said driven sprocket wheel is disposed rearwardly of said cylinder head cover and said cylinder head cover is formed such that a lower end face thereof is included obliquely downwardly toward the front.

17. The vehicle-carried 4-stroke cycle internal combustion engine according to claim 1, wherein said internal combustion engine is carried on a vehicle such that a crankshaft thereof is directed in a vehicle width-wise direction, and said driven sprocket wheel is disposed rearwardly of said cylinder head cover and said cylinder head cover is formed such that a lower end face thereof is included obliquely downwardly toward the front.

18. The vehicle-carried 4-stroke cycle internal combustion engine according to claim 1, wherein said 4-stroke cycle internal combustion engine comprises a breather plate attached to said cylinder head cover and forming said breather chamber, and said barrier is formed integrally with said breather plate.

19. A vehicle-carried 4-stroke cycle internal combustion engine comprising:

a valve chamber formed between a cylinder head and a head cover;

a cam chain chamber formed from said cylinder head and said cylinder head cover for accommodating a valve motion transmission means for imparting motion to a valve;

a breather chamber formed between an upper portion of said head cover and said valve chamber; and a barrier formed in an arcuate shape opposing to and extending along an outer circumference of said driven sprocket wheel from between cam chain sprocket wheels, said barrier being provided sidewardly of said driven sprocket wheel on said breather chamber side.

20. The vehicle-carried 4-stroke cycle internal combustion engine according to claim 19, wherein breather chamber entrances of said breather chamber are open in a direction perpendicular to a center axis of rotation of said driven sprocket wheel.

* * * * *